US005266255A

United States Patent [19]

Gibbon et al.

[11] Patent Number: 5,266,255

[45] Date of Patent: Nov. 30, 1993

[54] PROCESS FOR HIGH STRESS SPINNING OF POLYESTER INDUSTRIAL YARN

[75] Inventors: John D. Gibbon; Norman K. Porter, both of Charlotte, N.C.

[73] Assignee: Hoechst Celanese Corporation, Somerville, N.J.

[21] Appl. No.: 923,072

[22] Filed: Jul. 31, 1992

[51] Int. Cl.[5] ..... D01D 4/02; D01D 5/12; D01F 6/62; D02J 1/22

[52] U.S. Cl. ..... 264/210.7; 264/210.8; 264/211.14; 425/464

[58] Field of Search ..... 264/210.7, 210.8, 211.14; 425/464

[56] References Cited

U.S. PATENT DOCUMENTS 4,101,525 7/1978 Davis et al. ..... 528/308.2
4,195,052 3/1980 Davis et al. ..... 264/210.5
4,248,581 2/1981 Harrison ..... 425/464
4,414,169 11/1983 McClary ..... 264/210.7
4,514,350 4/1985 Roth et al. ..... 264/211.14
4,605,364 8/1986 Roth et al. ..... 425/72.2

*Primary Examiner*—Leo B. Tentoni
*Attorney, Agent, or Firm*—R. H. Hammer, III

[57] ABSTRACT

A process for high stress spinning of polyethylene terephthalate yarns to produce a yarn of improved mechanical properties is disclosed. The process of the invention is conducted by spinning polyethylene terephthalate polymer through a spinneret having a plurality of rows of orifices wherein at least one row of orifices is larger than adjacent row of orifices. The yarn is quenched by contacting filaments issuing from the larger orifice with a quench medium prior to contacting of the yarn issuing from the orifices of smaller size. Thereafter, the yarn is drawn at a draw ratio which is at least about 85% of the maximum draw ratio of the yarn. A yarn having improved strength and/or a reduced fray levels is produced.

23 Claims, 3 Drawing Sheets

PROCESS FOR HIGH STRESS SPINNING OF POLYESTER INDUSTRIAL YARN

FIELD OF THE INVENTION

The invention is directed to an improved process for producing high stress spun polyester industrial yarn. More specifically, the invention is directed to an improved high stress polyester industrial yarn spinning process wherein polyester polymer is spun under high stress to produce an as-spun yarn having a relatively high birefringence and is thereafter drawn in one or a plurality of stages.

BACKGROUND OF THE INVENTION

High stress spinning of polyester industrial yarns has during the past decade produced yarns which have achieved a remarkable commercial success. These yarns which have been referred to as high modulus, low shrinkage (HMLS) or dimensionally stable polyester (DSP) yarns, have become the preferred polyester yarn for reinforcement of various articles including tires, V-belts, hoses and the like. These yarns have many performance advantages. For example, in tires, sidewall undulation can be reduced and ride and performance can be improved. Moreover, the yarns have improved work loss characteristics such that less heat is generated by repeated stretching and relaxation of the yarns.

High stress spun polyester industrial yarns and processes for their production was first disclosed in U.S. Pat. No. 4,101,525 to Davis, et al. and 4,195,052 to Davis, et al., both of which are hereby incorporated by reference in the present specification. The polyester yarns and processes for their production, as disclosed in the Davis, et al. patents have substantially improved polyester reinforced products. In addition, U.S. Pat. No. 4,414,169 to McClary discloses an improved process for producing polyester high stress spun and in-line drawn yarns employing improved processing conditions. This patent is also hereby incorporated in the present specification by reference.

In general, the HMLS yarns are produced by melt spinning high intrinsic viscosity polyethylene terephthalate polymer under conditions of high stress so that the as-spun yarn has a birefringence of greater than about $9\times10^{-3}$ and thereafter drawing the high birefringence as-spun yarn to change or develop yarn physical properties, e.g., strength, modulus and shrinkage.

During the drawing process, the yarns are highly susceptible to mechanical damage which results in broken filaments and/or loops extending outwardly of the yarn bundle, known in the trade as frays. The broken filaments typically result from attempts to optimize the yarn properties by drawing the yarns to a draw ratio which is close to the maximum achievable for the particular yarn. In general, it is known that as the spun birefringence of the yarns is increased, the maximum draw ratio achievable for the particular yarn will decrease; however, a high as-spun birefringence is desirable for improving the stability of the internal yarn structure as explained more fully in the Davis, et al. and McClary patents.

As compared to the "conventional" industrial yarn products, the HMLS products generally may have a lower strength (measured as tenacity). Because the yarns have lower strength than the prior industrial polyester yarns the typical drawing process is often operated close to the maximum obtainable to achieve the highest strength and/or to optimize other properties, which in turn, results in the potential for an increase in the number of frays as discussed earlier. Although the frays can be reduced by lowering the severity of drawing conditions, the consequence can be a lower strength product or a product lacking other optimum properties.

Numerous process modifications have been proposed for improving the yarn tenacity, i.e. strength, and/or decreasing mechanical damage that is, reducing the number of frays in the drawn yarn. Such proposals have included improving the process uniformity and the uniformity of polymer used for spinning the yarns. In addition, it has been proposed to improve the process by improving heating control (for example at the spinneret), uniformity of quench, finish type and application and improving the quality and uniformity of the drawing and winding process. In general, however, success has been limited.

U.S. Pat. No. 4,514,350 to Roth, et al. and U.S. Pat. No. 4,605,364 to Roth, et al. disclose a method and apparatus for melt spinning polyester filaments wherein molten polymer is extruded through at least two rows of different size orifices in a single spinneret and thereafter subjected to quenching. The orifices nearer the quench source have a larger diameter than the orifices furtherest from the quench source. Fibers were spun according to the patent from a 0.62 IV polymer through orifices having diameters ranging from 0.009 in up to 0.010 in. The resultant filaments have a substantially decreased birefringence variability within the filament bundle and the denier variability among the filaments is substantially increased, which can improve the uniformity of dye uptake in the resultant filament.

In the case of high stress spun polyester industrial fibers, many of conventional process modifications do not effect the desired changes in the final product and in other cases, are not fully applicable or effective because of the high stress imposed upon the molten polymer streams during the high stress spinning stage and/or the significant drawing forces applied to the filaments in subsequent drawing stages.

SUMMARY OF THE INVENTION

The invention provides an improved process for producing high stress spun polyethylene terephthalate industrial fibers. The process of the invention can provide multi-filament yarns having equivalent strength, i.e. tenacity, while exhibiting lower fray levels, as compared to prior high stress spun polyester industrial yarns. The process of the invention is also capable of providing multi-filament polyester yarns having higher tenacities while having equal or lower fray levels than prior high stress spun polyethylene terephthalate yarns. Thus, mechanical properties of yarns including fray levels and/or yarn strength can be improved by the process of the invention.

The process of the invention is conducted by extruding molten polyethylene terephthalate of relatively high intrinsic viscosity (IV), preferably greater than 0.8 deciliters per gram (dl/g) through a spinneret having a plurality of rows of orifices with an average orifice diameter of between about 0.015 and about 0.035 inches (0.38 mm–0.89 mm). The orifices in at least one of the rows have orifice diameters which are greater than the diameters of orifices in an adjacent one of the rows of orifices. The filaments issuing from the spinneret are passed through a quench zone wherein the filaments are quenched by directing a gaseous medium successively across the rows of filaments issuing from the rows of orifices and wherein the quench medium is directed for contacting the filaments issuing from the row of larger orifices prior to contacting the filaments issuing from the row of smaller orifices. The multi-filament yarn is withdrawn from the quench zone at a stress sufficient to provide a spun birefringence of greater than about $20\times10^{-3}$ and the as-spun yarn is thereafter drawn, preferably to at least about 85% of its maximum draw ratio in one or a plurality of stages, preferably two stages, and preferably at a total draw ratio of between about 1.6 and about 2.4 depending on the spun birefringence of the yarn. Preferably, the spinneret includes at least about 5 rows of orifices and the average diameter difference between adjacent rows of orifices is between about 0.00005 in. and about 0.0003 in. (0.0013 mm and 0.0076 mm).

Although the reasons are not fully understood, it has been found that in the as-spun state, the multi-filament yarns of the invention do not exhibit filament diameter variations which are substantially different than the filament diameter variations found in as-spun yarns which are spun using a spinneret having identical orifice diameters in all orifices. Moreover, the as-spun yarns according to the invention can be drawn at higher draw ratios to produce higher tenacities without significantly increasing the fray levels of the yarns and/or can be drawn at draw ratios equivalent to those employed for prior commercially available HMLS yarns while exhibiting a lower fray level.

In preferred embodiments of the invention, the average orifice size in the multiple orifice spinneret is between about 0.020 and about 0.030 in. (0.51 mm to 0.76 mm). Advantageously, the polymer IV is greater than about 0.90 dl/g and the multi-filament yarn is withdrawn from the quench zone under conditions sufficient to provide a spun birefringence in the as-spun yarns of greater than about $30\times10^{-3}$. It is also preferred that the multi-filament yarn be withdrawn from the quench zone at a speed of greater than about 5000 feet per minute (1500 m/min) and that the as-spun yarn be thereafter drawn to provide a tenacity of about 7.0 g/den or greater.

Although in general, it has been believed that the maximum tenacity which could be developed in a multi-filament high stress spun polyester yarn was dependent primary upon the spun birefringence of the yarn and upon the intrinsic viscosity of the polymer used to spin the yarn, it has been found according to the invention that yarn tenacities can be substantially increased even though the yarn spun birefringence and polymer intrinsic viscosity are maintained at a constant level. Because higher tenacities can be achieved without substantially increasing the yarn frays, i.e. filament breakage, the invention also provides a process whereby high tenacities can be achieved without requiring the use of draw ratios at or near the point where substantial filament breakage is expected.

BRIEF DESCRIPTION OF THE DRAWINGS

In the drawings which form a portion of the disclosure of the invention.

DETAILED DESCRIPTION OF THE PREFERRED EMBODIMENT

In the following detailed description, various preferred embodiments of the invention are described in order to enable practice of the invention. It will be apparent however that in describing such preferred embodiments various terms are used in their descriptive sense and not for purposes of limitation. It will also be apparent that the invention is susceptible to numerous variations and modifications within the spirit of the following description.

Figure 1:
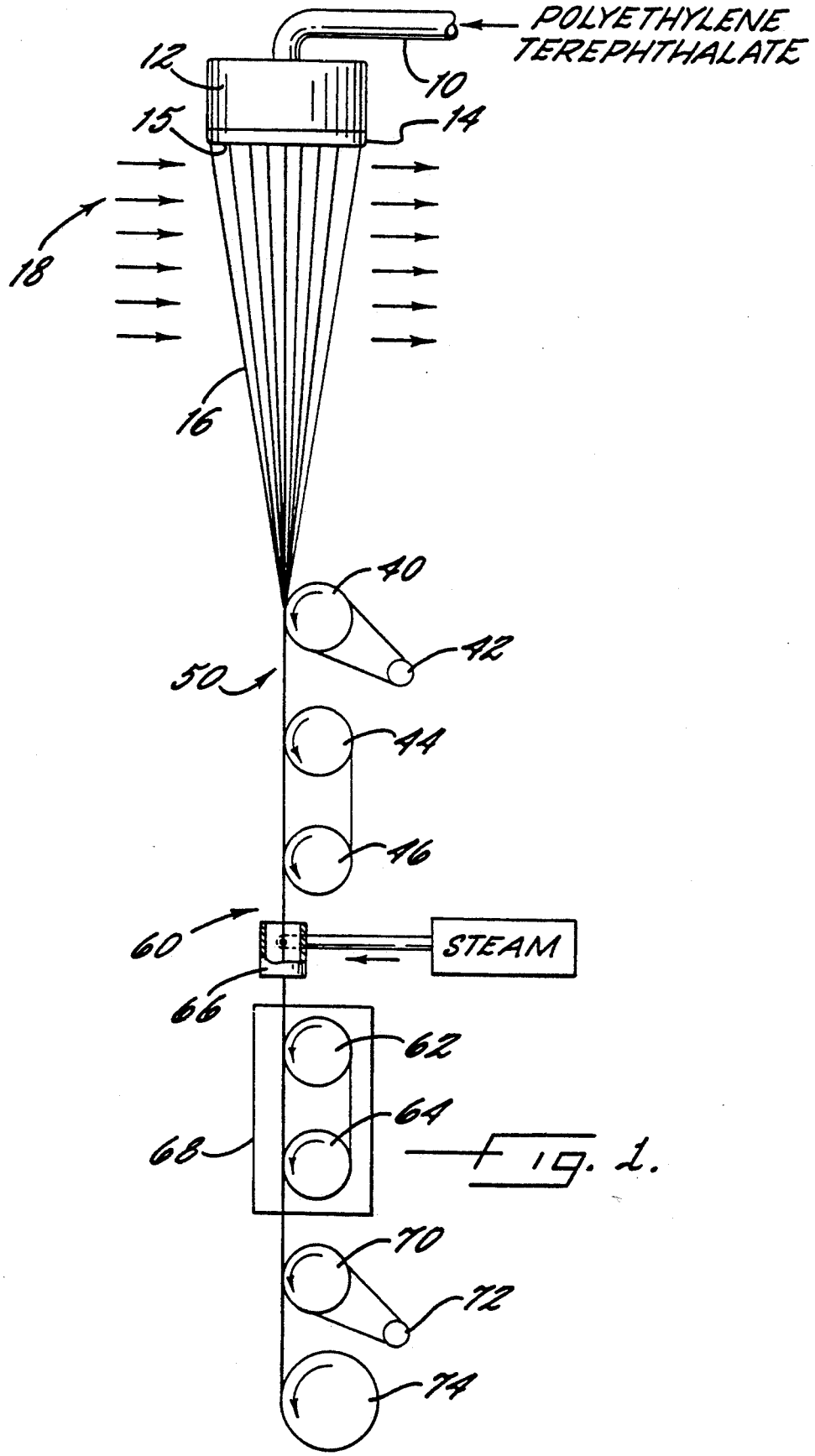
FIG. 1 illustrates schematically a preferred process and apparatus for spinning HMLS yarns according to the invention.

FIG. 1 illustrates a preferred process and apparatus for conducting the process of the invention. In FIG. 1, polyethylene terephthalate is fed from a source (not shown) via line 10 to a spinneret 12. The melt spinnable polyethylene terephthalate for use in the present process contains at least 85 mol % polyethylene terephthalate, and preferably at least 90 mol % polyethylene terephthalate. In a particularly preferred embodiment of the process, the polyethylene terephthalate is substantially all polyethylene terephthalate. Alternatively, during the polymerization process minor amounts of one or more ester-forming ingredient other than ethylene glycol and terephthalic acid or its other ester forming derivatives, e.g., dimethylterephthalate, may be copolymerized. For example, the melt spinnable polyethylene terephthalate includes 85 to 100 mol percent (preferably 90 to 100 mol percent) polyethylene structural units and 0 to 15 mol percent (preferably 0 to 10 mol percent) copolymerized ester units other than polyethylene terephthalate. Illustrative examples of other ester-forming ingredients which may be copolymerized with the polyethylene terephthalate units include glycols such as diethylene glycol, trimethylene glycol, tetramethylene glycol, hexamethylene glycol, etc., and dicarboxylic acids such as isophthalic acid, hexahydroterephthalic acid, bibenzoic acid, adipic acid, sebacic acid, azelaic acid, etc. A minor amount of an active agent such as an intrinsic viscosity modifying agent, an endcapping agent, or the like, e.g., phenylglycidyl ether, ethylene oxide, etc., optionally may be present in physical admixture with the melt-spinnable polyethylene terephthalate.

The polyethylene terephthalate may be conveniently formed via a multiple stage continuous polymerization process wherein continuously polymerized polyethylene terephthalate is fed directly from the final polymerization vessel directly to the spinneret. Alternatively, the polyethylene terephthalate may be provided by melting previously formed polyethylene terephthalate chip, which in turn, can have been prepared according to any of various conventional processes including continuous polymerization, batch polymerization and/or solid state polymerization of previously formed polyethylene terephthalate chip.

The polyethylene terephthalate for use in the present process prior to extrusion is selected to have an intrinsic viscosity (IV) of from about 0.6 to about 2.0 dl/g and preferably a relatively high IV of greater than about 0.8 dl/g, and most preferably greater than about 0.90 dl/g. The IV of the polyethylene terephthalate may be conveniently determined by the equation:

$$IV = \lim_{c \to o}\left(\frac{\ln \eta_r}{c}\right)$$

Where $\eta_r$, is the "relative viscosity" obtained by dividing the viscosity of a dilute solution of the polymer measured at 25° C., by the viscosity of the solvent employed (orthochlorophenol) measured at the same temperature, and c is the polymer concentration in the solution expressed in grams/100 ml.

Returning to FIG. 1, the molten polyethylene terephthalate is extruded through a spinning pack 12 including spinneret 14 and the filaments 16 are quenched by contact with a quench fluid 18, illustrated as a cross flow quench, which contacts the filaments issuing from the face of spinneret 14. If desired, a quench delay zone of conventional type may be interposed between spinneret 14 and quench 18.

Figure 2:
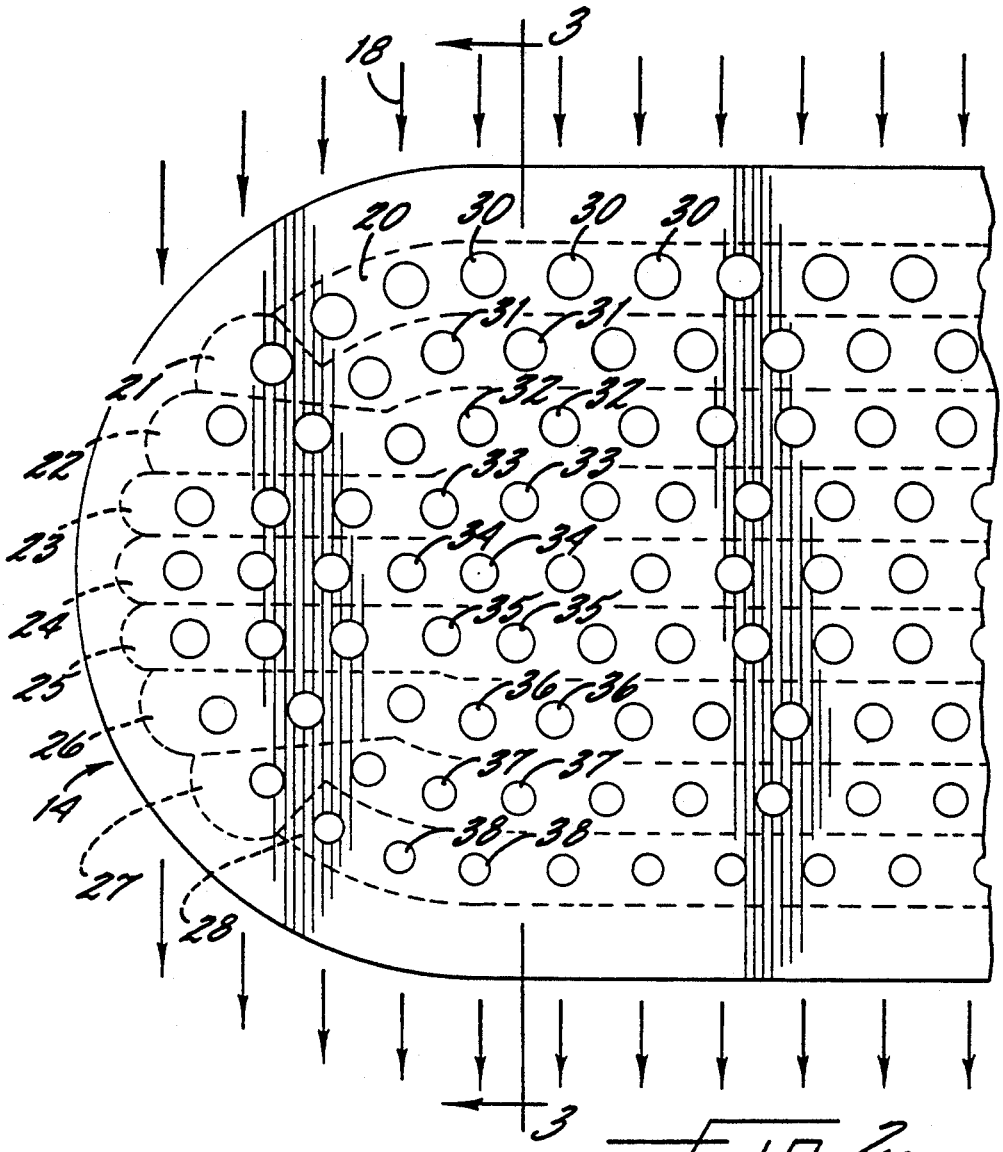
FIG. 2 is a partial bottom plan view of a preferred oval patterned spinneret wherein the differences in orifice diameter between adjacent rows of orifices are exaggerated for the sake of illustration and wherein the direction of flow of quench fluid is illustrated by arrows.

FIG. 2 illustrates a partial bottom plan view of spinneret 14 which is shown as an oval-shaped spinneret (also known as a "rectangular" or "race track" shaped spinneret). As discussed in detail, later, this configuration is not limiting. The spinneret 14 includes nine rows, 20, 21, 22...28, of orifices which are spaced from the spinneret edge nearest the quench source and arranged substantially transversely to the direction of quench fluid 18. The diameter of the orifices 30 in the first row 20 are larger than the diameters of the orifices 31 in the second row 21. Similarly, the diameter of the orifices 32, 33, 34...38 in the successive rows 22, 23, 24...28, successively decrease so that the diameter of the orifices 38 in row 28 which is spaced most distantly from the source of quench fluid 18, are of the smallest size. The absolute size variation between adjacent rows of orifices are shown in exaggerated detail in FIG. 2 simply for the purpose of illustration. As known to the skilled artisan, a typical spinneret can include two or more orifice clusters arranged in a side-by-side arrangement.

A heated ring or shroud (not shown) may be provided after the spinneret and before quenching (discussed below) of the filaments. This optional ring is provided, in part, to add additional control over the spun birefringence, as is well known in the art. Also, a "delay or quiescent" zone (not shown) may be present after the spinneret and before filament quenching. This optional zone is provided, in part, to improve temperature uniformity on the face of the spinneret, as is well known in the art.

Figure 3:
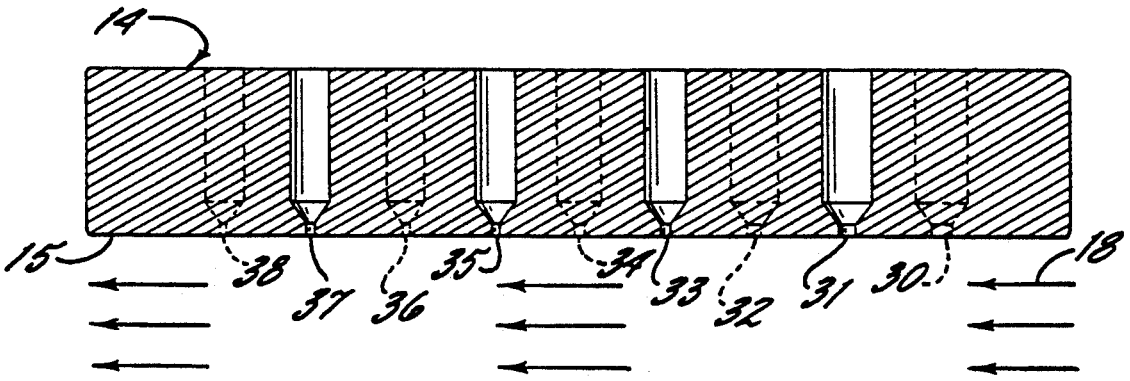
FIG. 3 is a cross-sectional view of the spinneret of FIG. 2 taken along line 3—3 of FIG. 2.

As best seen in FIG. 3, the source of quench fluid 18 which is provided beneath the face 15 of spinneret 14 is arranged for contacting the filaments issuing from the larger orifices 30 prior to contact with the gradually decreasing size orifices 31–38. The quench fluid 18 is typically air and may conveniently have an initial temperature of between about 10 and about 60° C., for example from about 10 to about 50° C., preferably from about 10 to 40° C., for example, room temperature or about 25° C. As the quench fluid 18 contacts the first row of filaments issuing from orifices 30 it is gradually warmed by contact with the hot filaments so that there is a gradually increasing temperature gradient in the quench fluid in the direction of the flow of the quench fluid across the rows of filaments issuing from the rows 20–28 of filaments. Because the cooler quench fluid contacts the larger filaments, while the warmer quench fluid contacts the smaller filaments, the rate of cooling of the filaments, i.e. the rate of quench, is more uniform across the rows of filaments as compared to the use of prior art spinnerets wherein all orifices are of the same diameter. As discussed in greater detail later, it has been found that even though the orifices have different diameters, the variation of filament diameters within the multi-filament yarn produced during high stress spinning, are not significantly different than the variation of filament diameters produced using a constant orifice size spinneret as in the prior art.

Returning to FIG. 1, the quenched polyethylene terephthalate filaments 16 are withdrawn from the quench zone by a first set of feed rolls including a driven roll 40 and a skewed separator roll 42. Prior to contact with driven roll 40, a spun yarn finish is typically applied to the yarn by light contact with a kiss roll or the like, not shown. The driven roll 40 is typically operated at a roll surface speed greater than about 3000 ft/min (900 m/min), preferably at a speed of between about 3,000 and about 15,000 ft/min (900–4,500 m/min) to thereby impart substantial stress on the filaments withdrawn from the quench zone and to impart a birefringence greater than about $20\times10^{-3}$, preferably greater than about $30\times10^{-3}$ to the as-spun filaments.

As will be apparent to those skilled in the art, the spun birefringence of the yarn is influenced by the molecular weight, i.e., IV, of the polymer, the temperature of the molten polymer when extruded and quenched, the size of the spinneret openings, the polymer throughput rate during melt extrusion, the quench temperature and the rate at which the as-spun yarn is withdrawn from the quench zone.

The as-spun multi-filament yarn as it leaves the quench zone advantageously has a denier per filament (dpf) of between about 2 and about 15, preferably between about 3 to about 10 dpf. Advantageously, the multiple orifice spinneret includes a plurality of orifices ranging from about 50 to about 1500 orifices or more to thereby produce a multi-filament yarn having between about 50 and about 1500 or more total filaments per yarn.

Returning again to FIG. 1, the multifilament yarn withdrawn by rolls 40 and 42 from the quench zone is next passed to a pair of driven skewed rolls 44 and 46 which are rotated at a greater rate than driven roll 40 so that the yarn is drawn in a first draw zone 50 which is located between the first set of rolls 40 and 42 and the second set of rolls 44 and 46. Although FIG. 1 illustrates the first draw zone as an in-line coupled draw zone, the as-spun yarn withdrawn from the quench zone can alternatively be wound up prior to entry into a separate draw zone such as a warp-draw or the like. Advantageously, no external heat is applied to the yarn during its passage through the first draw zone 50 in accordance with the teachings of U.S. Pat. No. 4,414,169 to McClary. While present in the first draw zone, the yarn is advantageously drawn in an amount of between about 20 and about 80% of the maximum draw ratio wherein the term "maximum draw ratio" of the as-spun filamentary material is defined as the maximum draw ratio to which the as-spun filamentary material may be drawn at a practical and reproducible basis without encountering breakage thereof.

It will be apparent to the skilled artisan that the degree of draw applied to the spun yarn will be dependent on the spun birefringence of the yarn. Preferably, the yarn is drawn in the first draw zone at a draw ratio ranging from about 1.1:1 up to about 1.75:1, preferably between about 1.2:1 and about 1.5:1, depending on the spun birefringence of the yarn. It will be apparent to the skilled artisan that the yarn is wrapped a plurality of turns about rolls 40 and 42 and about rolls 44 and 46 to provide sufficient surface contact between the rolls and the yarn to prevent excess slippage during drawing.

The drawing of the as-spun filaments in the first draw zone 50 is advantageously conducted in an in-line continuous manner immediately following passage of the yarn from the quench zone; however, as indicated earlier, a split draw can be employed when desirable. The apparatus used to carry out the drawing in the first zone can be readily varied as will be appreciated by those skilled in the art.

Following treatment in the first draw zone, the yarn is thereafter passed through a second draw zone 60 and to a pair of driven rolls 62 and 64 which are operated at a surface speed greater than that of driven rolls 44 and 46. Depending on the spun birefringence the yarn is drawn in the secondary zone at a draw ratio of from about 1.2:1 up to about 1.8:1, preferably 1.4:1 up to 1.8:1, to provide a total ratio for the as-spun yarn ranging from about 1.8:1 to up to about the maximum drawn ratio for a given birefringence, preferably from about 1.9:1 up to about 2.3:1. During passage through the second draw zone 60, the yarn is advantageously contacted by hot steam by passage through a steam jet 66. The steam applied to the yarn by passage through in steam jet 66, typically has a temperature which is determined by yarn speed, denier, etc.

During the final drawing step, the yarn is advantageously heated by contact with heated draw rolls. As illustrated in FIG. 1, such heating can be conveniently carried out by enclosing the final draw rolls 62 and 64 within a heated drawing enclosure 68 which is maintained at a temperature in the range of from about 190 to 260° C., preferably from about 200 to about 250° C.

The drawn yarn is advantageously removed from the second set of draw rolls 62 and 64 and is preferably allowed to relax slightly while being fed to a driven roll 70 and separator roll 72. The relaxation, conditioning or shrinkage step, which is optional, is accomplished by operating driven roll 70 at a surface speed of from about 1 to about 10 percent less than the surface speed of the draw rolls 62 and 64. The optional shrinkage step tends to further reduce the residual shrinkage characteristics of the final yarn and to increase the elongation of the final product. The yarn is then collected at a winder 74.

The yarn produced in accordance with the invention advantageously has a tenacity of at least about 6.5 g/den., preferably 7.0 g/den. measured at 25° C. and more preferably a tenacity of at least 8.0 g/den. The tensile properties, including yarn tenacity, elongation a break and elongation at specified load, are conveniently determined through the use of an Instron tensile tester using a 10 inch gauge length and a strain rate of 120 percent per minute. The fibers prior to testing are preferably conditioned for several hours, e.g., 48 hours, at 70° F. and 65% relative humidity.

Shrinkage when measured in air at 175° C. (Hot Air Shrinkage) is commonly less than 8.5 percent, preferably less than 7.0 percent measured using a preheated oven and an applied load of substantially 0, wherein a 10 meter length of yarn is wrapped about a 1 meter circular wheel to form a skein which is removed, doubled, hung on a rack and then heated for 30 minutes, conditioned (i.e. removed from oven and allowed to cool at ambient condition without any load) for 30 minutes, and shrinkage measured.

Figure 4:
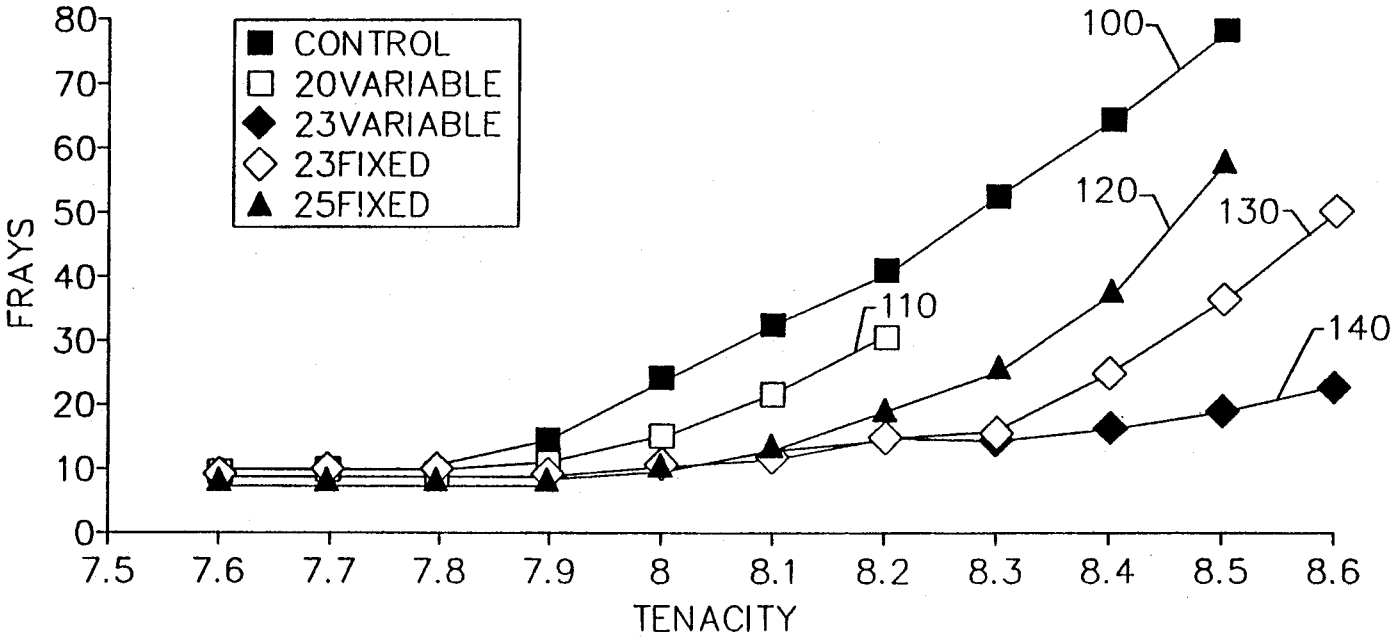
FIG. 4 is a graph illustrating tenacities and fray counts of drawn yarns produced from as-spun yarns having substantially identical birefringence properties spun from spinnerets having a constant orifice diameters and having orifice diameters which are different from row to row.

In FIG. 4 there are shown the results of spinning polyethylene terephthalate yarns according to the present invention and as compared with prior art processes. The yarns were spun using the same polyethylene terephthalate polymer such that the IV of the as-spun yarn was 0.91 dl/g. Five different spinneret constructions were used, each having the same arrangement as shown in FIG. 2 except that orifice diameters were varied. In a first spinneret, labeled "Control" in FIG. 4, all orifices had the same diameter of 0.020 in. In a second spinneret, labeled "20 Variable", the orifice size was decreased by about 0.0001 inch from row to row beginning with row 20 (FIG. 2) and wherein the middle row (row 24) orifices had a diameter of 0.020 in. In a third spinneret, labeled "23 Variable", the orifices were varied in diameter from row to row in an amount of 0.0001 in. In this case, the orifices in the middle row, row 24, had a diameter of about 0.023 in. In a fourth spinneret, labeled "23 Fixed" all orifices had the same diameter of 0.023 in. In a fifth spinneret, labeled "25 Fixed" all orifices had the same diameter of 0.025 in.

The yarns were spun under conditions to produce substantially identical spun yarn birefringence values of approximately $31\times10^{-3}$. Polymer throughput conditions and wind-up speeds were varied slightly to achieve the substantially identical birefringence values in the as-spun yarn. Thus, with larger diameter spinneret orifices, polymer throughputs were decreased and feed roll speeds were decreased to maintain yarn spun birefringence and dpf substantially constant. The spun yarns were drawn over a total draw ratio which was varied from about 1.95:1 to about 2.15:1 and fray levels were measured.

From FIG. 4, it can be seen that the variable orifice sized spinnerets used in the invention allow significantly improved mechanical properties in the resultant yarns (i.e., yarns having equal or higher tenacities with equal or lower fray levels). Thus, in curve 100 (representing a prior art yarn) it is seen that if the yarn is drawn to an extent to achieve above about 8.0 grams per denier tenacity, the level of yarn frays begins to increase dramatically. In curve 110, which employed a variable orifice size spinneret, higher tenacities could be achieved at equal or lower fray levels as compared to the spinneret having a fixed orifice size of 0.020 in. Similarly, curves 120 and 130 demonstrate that even higher tenacities with equal or lower fray levels can be achieved using fixed orifice size spinnerets having orifice sizes of 0.025 and 0.023 in., respectively. In curve 140, it is seen that a variable orifice size spinneret having an average orifice size of 0.023 in. produced yarns of superior tenacities and lower fray levels as compared to either of the yarns produced from the 0.023 or 0.025 fixed orifice size spinnerets.

From FIG. 4, it is apparent that variable orifice size spinnerets employed according to the invention are capable of providing superior yarn fray levels and/or superior yarn tenacities. It is also apparent from FIG. 4 that the average spinneret orifice size can also be varied to improve yarn tenacities and fray levels. In this regard, the average orifice diameter will be determined depending upon numerous variables including the desired spun yarn denier per filament (dpf) and birefringence; polymer intrinsic viscosity; spun yarn take up speed; polymer throughput rate; polymer throughput temperature; and quench rate and temperature. In general, for drawn yarns having a dpf ranging from about 1 to about 5 and with regard to as-spun dpfs ranging from about 3 to about 15, the average orifice diameter is preferably maintained within the range of between about 0.015 in to about 0.035 in (0.38 mm to about 0.89 mm), preferably from about 0.20 in to about 0.30 in (0.51 mm to about 0.76 mm) more preferably from about 0.022 in to about 0.025 in (0.56 mm to 0.64 mm). It will be apparent to the skilled artisan that the average orifice size will also be varied within the above range depending upon polymer IV, polymer throughput and the rate at which the spun yarn is withdrawn from the quench zone.

Although an oval or rectangular shaped spinneret is illustrated in FIG. 2, it will be apparent that the invention can also be advantageously employed with circular shaped spinnerets, with annular shaped spinnerets and other spinneret designs. For example with an annular spinneret employing an outflow quench, the interior spinneret orifices are closer to the source of quench fluid and are thus provided at a larger orifice diameter as compared to the spinneret orifices at the exterior of the annular spinneret. Similarly, in an annular spinneret using an inflow quench, the orifices at the exterior of the annular spinneret are provided with a larger orifice diameter as compared to the orifices at the interior of the annular spinneret. With a circular spinneret when employing a cross flow quench, the orifices are divided into linear or nonlinear rows according to their distance from the source of quench fluid and the orifice diameters are varied as discussed above.

The average variation in orifice diameter between adjacent rows of spinneret orifices is advantageously between about 0.00005 in. and about 0.0003 in. (between about 0.0013 mm and about 0.0076 mm). Preferably, the average diameter difference between adjacent rows of orifices is between about 0.0001 in. and about 0.0002 in. (0.0025 mm and 0.0051 mm). Depending upon factors such as the polymer IV and throughput, the spinning speed and the spun dpf of the yarn, such variations in orifice diameters can be made without substantially changing the variability of the individual diameters of the individual filaments within the spun yarns as compared to filaments spun from spinnerets having constant orifice diameters. Although not wishing to be bound by theory, it is believed that the high stress spinning conditions employed to produce HMLS yarns result in a filament diameter variability such that the degree of variability introduced by varying the orifice diameter sizes can readily be tolerated without a significant impact on the variability of filament diameters. In many instances, the variations in birefringence among the filaments in the as-spun yarn are improved by the present process while in other instances, the variability in birefringence of the individual filaments in the as-spun yarn appears to be minimal. Nevertheless, the process of the invention provides substantially improved quench uniformity such that improved mechanical properties, i.e., improved yarn tenacities and/or fray levels can be obtained in the subsequent drawing stage or stages as discussed previously.

The variation in orifice size from row-to-row in the spinneret can be accomplished in various ways according to the invention. For example, orifice sizes in adjacent pairs of spinneret rows can be constant and variations can be provided between adjacent pairs of rows. Similarly, in some instances it can be desirable to have orifice size changes in only every third row of orifices, etc. In addition, although it is preferred that the orifice diameters within each row be substantially the same, variations in orifice diameter within a row can be made where desirable.

Because the invention provides fully drawn yarns having higher strength levels with equivalent or lower fray levels, modifications in spinning temperatures and in polymer IV can be made to improve process stability and/or improve process costs without sacrificing yarn properties. Thus, using the process of the invention a multi-filament yarn can be spun at identical spun yarn birefringence values and identical drawn yarn tenacities and fray levels while employing a starting polymer IV which is lower in an amount of between about 0.01 and about 0.03 IV units.

It will be apparent that the invention is susceptible to numerous variations. Thus, for example, the process has been described with reference to a two-stage drawing process; however, the spun yarn can be drawn in one stage or in several coupled or split stages to achieve draw ratios in the range of between about 1.6:1 to about 2.4:1, preferably in the range of between about 1.8:1 to about 2.2:1. Moreover, although in preferred embodiments of the invention, the yarn is heated during or subsequent to drawing it is also within the scope of the invention to vary or eliminate such heating as discussed, for example, in the previously mentioned U.S. Pat. No. 4,414,169 to McClary.

In the following examples, various yarns were spun according to the process data set forth below. Fiber tenacities and other tensile properties, fiber shrinkage, and polymer intrinsic viscosities were measured in the manner previously indicated. Birefringence values can be determined in the conventional manner using an interference microscope or a Berek compensator mounted in a polarizing light microscope. Fray counts were determined using a TORAY Fray Counter, Model No. DT104 filament head. This optical system can be adjusted for sensitivity depending on the type of yarn examined. In the case of industrial polyester yarns, the minimum sensitivity is set to a relatively low sensitivity of 1.0 mm and 500 ft. of yarn are examined during a time of 60 sec. Thus, the "fray" values are valid for relative comparisons.

EXAMPLE 1

In this example two graduated orifice spinnerets (Spinnerets A and B) were constructed, each spinneret having two clusters of orifices having the oval pattern illustrated in FIG. 2. The orifice sizes and number of orifices in each row (for each cluster) were as follows:

TABLE 1

| Row | Number of Orifices | Orifice diameter (in $\times 10^{-3}$) |
|---|---|---|
| 1 | 16 | 20.4 |
| 2 | 17 | 20.3 |
| 3 | 19 | 20.2 |
| 4 | 20 | 20.1 |

TABLE 1-continued

| Row | Number of Orifices | Orifice diameter (in $\times 10^{-3}$) |
|---|---|---|
| 5 | 20 | 20.0 |
| 6 | 20 | 20.0 |
| 7 | 19 | 19.9 |
| 8 | 17 | 19.8 |
| 9 | 16 | 19.7 |

Spinneret C, the control spinneret, had the same oval pattern as the experimental spinneret with the same number or row of orifices and the same number of orifices per row. However, in the control spinneret the orifice diameters were the same for each orifice and were $20\times10^{-3}$ in.

All yarns were spun on the same apparatus having the arrangement generally as shown in FIG. 1 at a throughput rate of 50–55 lbs/hr and the as-spun yarn has a 0.87 IV. The quench air was maintained at a temperature of about 35° C. For each spinneret, a constant wind up speed of 12,000 ft/min was used; however, draw ratios were varied and polymer throughputs were varied to achieve a constant fully drawn total denier of 1,000. For each yarn, the draw ratio was started at 2.18:1 and raised in increments of 0.06 until the process would no longer run. The drawn yarn was tested for physical properties and for frays. Spun yarn was tested for birefringence variability.

Table 2 below sets forth data obtained by comparing yarn properties for yarns spun at draw ratios of 2.44.

TABLE 2

| Spinneret | Birefringence $\times 10^3$ | Birefringence coefficient of Variation | Diameter ($\mu$) | Diameter Coefficient of Variation |
|---|---|---|---|---|
| A | 27.14 | 6.69 | 25.8 | 5.78 |
| B | 26.36 | 7.06 | 26.2 | 6.08 |
| C | 25.58 | 7.88 | 26.8 | 5.22 |

NOTE:
Birefringence and Diameter are dependent on draw ratio. Birefringence Coefficient of Variation and Diameter Coefficient of Variation were not dependent on Draw Ratio.

As can be seen from the above values, although the coefficient of variation in birefringence was different with the graduated orifice size spinnerets, the difference was relatively minor. Although the coefficient of variation of spun yarn diameters were expected to be substantially different, very little differences were observed.

The following Table 3 sets forth a comparison of drawn yarn properties at a draw ratio of 2.54 by spinneret.

TABLE 3

DRAWN YARN PROPERTIES AT 2.54:1 DRAW RATIO

| Spinneret | Tenacity (g/den) | Eb | E10** | HAS*** | Frays |
|---|---|---|---|---|---|
| A | 8.24 | 10.4 | 5.77 | 6.6 | 26.5 |
| B | 8.33 | 10.5 | 5.80 | 6.7 | 36.0 |
| Control | 8.19 | 10.7 | 5.72 | 7.1 | 51.0 |

*Elongation at Break
**Elongation at 10 lbs., (1000 total denier yarn)
***Hot Air Shrinkage (175° C.)

It can be seen that the graduated orifice spinnerets produced significantly lower fray levels than the conventional spinneret.

In general, the constant orifice size spinneret produced a spun yarn birefringence which was lower than the spun yarn birefringence produced by the graduated orifice spinnerets when the yarns were spun under the same conditions. In order to minimize the expected effects of birefringence differences, the data was analyzed to provide a comparison of fray levels at different spun yarn tenacities according to spinneret. To do this, regression equations were developed for the yarns produced by each spinneret using a quadratic model. From these equations, fray values at equal tenacities were calculated and are listed below in Table 4.

TABLE 4

Calculated Fray Levels for Each Spinneret for a Tenancity Range

| Tenacity g/den | Frays | | | |
|---|---|---|---|---|
| Spinneret | 8.0 | 8.1 | 8.2 | 8.3 |
| A | 5 | 13 | 23 | 37 |
| B | 3 | 10 | 19 | 30 |
| Control | 15 | 27 | 41 | 58 |

From the above, it can be seen that fray levels were significantly lower with yarns spun according to the process of this invention, using graduated orifice size spinnerets.

EXAMPLE 2

This Example sets forth the spinning conditions used to obtain the data shown in FIG. 4 (discussed previously). All spinnerets had the same arrangement and number of orifices as were used in Example 1, above. The "Control" and "20 Variable" spinnerets were the same as were used in Example 1 above. The "23 Variable" spinneret had the following diameters for orifices in rows 1–9 respectfully, wherein values are set forth as (in. $\times10^3$): 23.5; 23.4; 23.3; 23.15; 23.05; 22.9; 22.65; 22.55; 22.40. The "23 Fixed" and "25 Fixed" spinnerets had constant orifice sizes of $23\times10^{-3}$ in. and $25\times10^{-3}$ in., respectively.

In each case, the yarns were spun using the arrangement set forth in FIG. 1. The yarns were quenched in the quench zone at a quench air temperature of about 35° C. The spinnerets were the same as discussed above in Example 1. In the case of the "20 Fixed" spinneret, the polymer throughput was approximately 53 lb/hour and the yarn was withdrawn from the quench zone at a rate of about 1,525 m/min. In the case of the remaining spinnerets, the polymer throughput and withdrawal speed from the quench zone was increased slightly to maintain the birefringence constant for each of the spun yarns while maintaining the same denier per filament.

The results are discussed previously and it is readily seen that mechanical quality of the drawn yarns is greatly improved by the process of this invention.

EXAMPLE 3

Example 2 was repeated using a substantially higher withdrawal rate from the quench zone. In this case, the withdrawal rate from the quench zone was approximately 2,125 m/min. The yarns were spun using both the "20 Fixed" and the "23 Variable" spinnerets. The draw ratio was varied from 1.97:1 to 2.212:1 and fray levels were measured. Polymer spinning temperatures were also varied from approximately 295° C. up to about 300° C. When yarns having approximately the same spun birefringence of $45\times10^{-3}$ were compared, it was found that for the same yarn tenacities, yarns spun according to the present invention had substantially improved fray levels. For drawn yarns having tenacities of 8.0 g/den., fray level was reduced from approximately 50 to approximately 15 using the process of this invention.

The invention has been described in considerable detail with reference to its preferred embodiments, however, it will be apparent that numerous modifications and variations can be made within the spirit and scope of the invention as described in the foregoing detailed specification and defined in the appended claims.

That which is claimed is:

1. An improved process for high stress spinning polyethylene terephthalate industrial multi-filament yarn comprising:

extruding molten polyethylene terephthalate of an intrinsic viscosity of at least about 0.80 dl/g through a spinneret having a plurality of rows of orifices with an average diameter of between about 0.015 in. and about 0.035 in., the orifices in at least one of said rows having orifice diameters which are greater than the diameters of orifices in an adjacent one of said rows;

passing the filaments issuing from said spinneret through a quench zone wherein the filaments are quenched by directing a gaseous medium successively across the rows of filaments issuing from the rows of orifices and wherein the quench medium contacts the filaments issuing from said row of larger orifices prior to contacting the filaments issuing from said row of smaller orifices;

withdrawing multi-filament yarn from said quench zone under conditions sufficient to provide a spun birefringence in said multi-filament yarn of greater than about $20\times10^{-3}$; and thereafter drawing said yarn to at least 85% of the maximum draw ratio thereof; whereby mechanical properties of the draw multi-filament yarn are improved.

2. The process of claim 1 wherein said molten polyethylene terephthalate is of an intrinsic viscosity of at least about 0.90 dl/g.

3. The process of claim 1 wherein said multi-filament yarn is withdrawn from said quench zone at a speed of at least 1,500 m/min.

4. The process of claim 1 wherein said multi-filament yarn withdrawn from said quench zone is drawn in an amount to provide a drawn yarn tenacity of at least 6.5 g/den.

5. The process of claim 1 wherein said drawn yarn is drawn in an amount to produce a drawn yarn tenacity of at least about 8.0 g/den.

6. The process of claim 1 wherein said spinneret includes at least about 5 rows of orifices and wherein the average orifice diameter is between about 0.020 in and 0.030 in.

7. The process of claim 1 wherein the average diameter difference between adjacent rows of orifices is between about 0.00005 in. and about 0.0003 in.

8. The process of claim 7 wherein each adjacent row of orifices has a different average diameter and wherein the average diameter difference between adjacent rows of orifices is between about 0.0001 and about 0.0003 in.

9. The process of claim 1 wherein said multi-filament yarn is withdrawn from said quench zone at a stress sufficient to provide a spun yarn birefringence of at least $30\times10^{-3}$.

10. The process of claim 1 wherein said drawing step is conducted subsequent to storage of said as-spun yarn.

11. The process of claim 1 wherein said drawing step is conducted in a single stage.

12. The process of claim 1 wherein said drawing step is conducted in a plurality of stages.

13. An improved process for the production of high strength industrial polyester multi-filament yarn comprising the steps:

extruding molten polyethylene terephthalate having an intrinsic viscosity of at least about 0.90 dl/g through a spinneret having at least 5 rows of orifices with an average orifice diameter between about 0.020 and about 0.030 in. wherein at least one of the rows have average orifice diameters which are greater than the average orifice diameters in an adjacent one of the rows of orifices;

passing the filaments withdrawn from said spinneret through a quench zone wherein said filaments are quenched by directing a gaseous medium successively across the rows of filaments issuing from said rows of orifices and wherein the quench medium contacts the filaments issuing from the row of larger orifices prior to contacting the filaments issuing from the row of smaller orifices;

withdrawing a multi-filament yarn from said quench zone at a speed of at least about 1,500 m/min; and drawing said yarn withdrawn from said quench zone in at least one drawing stage in a continuous inline manner to at least about 85% of the maximum draw ratio thereof.

14. The process of claim 13 wherein said yarn is drawn in two drawing stages.

15. The process of claim 14 wherein said yarn produced by said process is sufficiently drawn to provide a strength of at least about 8.0 g/den.

16. The process of claim 15 wherein said multi-filament yarn is withdrawn from said quench zone exhibits a birefringence of at last $30\times10^{-3}$.

17. An improved process for the manufacture of multifilament polyethylene terephthalate yarn from a polyethylene terephthalate polymer having an intrinsic viscosity of at least about 0.80 dl/g comprising improving the mechanical properties of the drawn yarn by melt spinning multifilament polyethylene terephthalate yarn at a spun birefringence of at least about $30\times10^{-3}$ employing a spinneret having a plurality of rows spaced consecutively away from an edge portion of said spinneret, each of said rows having a plurality of orifices with an average orifice diameters of from about 0.015 in. to about 0.035 in. and wherein the row of orifices closest to said edge has an average orifice diameter which is smaller than at least one of another of said rows.

18. The process of claim 17 wherein said polyethylene terephthalate polymer is of an intrinsic viscosity of at least about 0.90 dl/g.

19. The process of claim 17 wherein said polyethylene terephthalate yarn melt spun at a spun birefringence of at least about $30\times10^{-3}$ is thereafter drawn in an amount sufficient to provide a drawn yarn tenacity of at least about 7.0 g/d.

20. The process of claim 19 wherein said drawing step is conducted following storage of said melt spun yarn.

21. The process of claim 19 wherein said drawing step is conducted in a single stage.

22. The process of claim 19 wherein said drawing step is conducted in a plurality of stages.

23. The process of claim 17 wherein said spinneret comprises at least about five rows of orifices and wherein the average orifice diameter increases consecutively from row to row.

* * * * *